US010066920B2

(12) United States Patent
Humphries et al.

(10) Patent No.: US 10,066,920 B2
(45) Date of Patent: Sep. 4, 2018

(54) REMOTE INITIATOR RECEIVER

(71) Applicant: MAS ZENGRANGE (NZ) LIMITED, Lower Hutt (NZ)

(72) Inventors: Tony Humphries, Lower Hutt (NZ); Adam Holdaway, Lower Hutt (NZ); Mark Cooling, Lower Hutt (NZ); Andre Lubbock, Lower Hutt (NZ); Murray King, Lower Hutt (NZ); Aaron Cho, Lower Hutt (NZ); David Hamilton, Lower Hutt (NZ)

(73) Assignee: MAS ZENGRANGE (NZ) Limited, Lower Hutt (NZ)

( * ) Notice: Subject to any disclaimer, the term of this patent is extended or adjusted under 35 U.S.C. 154(b) by 375 days.

(21) Appl. No.: 14/430,221

(22) PCT Filed: Dec. 13, 2012

(86) PCT No.: PCT/NZ2012/000236
§ 371 (c)(1),
(2) Date: Mar. 21, 2015

(87) PCT Pub. No.: WO2014/065676
PCT Pub. Date: May 1, 2014

(65) Prior Publication Data

US 2015/0211833 A1 Jul. 30, 2015

(30) Foreign Application Priority Data

Oct. 23, 2012 (NZ) ..... 603164

(51) Int. Cl.
*F23Q 21/00* (2006.01)
*F42D 1/045* (2006.01)
(Continued)

(52) U.S. Cl.
CPC ..... *F42D 1/045* (2013.01); *F42B 3/14* (2013.01); *F42C 11/00* (2013.01); *F42C 13/04* (2013.01); *F42D 1/043* (2013.01)

(58) Field of Classification Search
USPC ..... 361/248
See application file for complete search history.

(56) References Cited

U.S. PATENT DOCUMENTS 8,134,822 B2 * 3/2012 Ballantine ..... F42D 5/00 102/200
9,618,308 B2 * 4/2017 Lucas ..... F42C 19/12
(Continued)

FOREIGN PATENT DOCUMENTS

CA 2548025 A1 * 6/2005 ..... C06C 5/04
WO WO 2005054073 A1 * 6/2005 ..... C06C 5/04

*Primary Examiner* — Ronald W Leja
(74) *Attorney, Agent, or Firm* — Inventa Capital PLC

(57) ABSTRACT

An expendable remote initiator receiver for initiating at least one shock tube connectable to an explosive charge. The receiver includes a shock tube interface that directly interfaces with a shock tube connected to an explosive charge, a spark initiator that initiates a spark at the shock tube interface to initiate the shock tube, a multifunctional shock tube interface adaptor mounted and connected to the shock tube interface, wherein the multifunctional shock tube interface connects the ground of a printed circuit assembly (PCA) to the shock tube needle to allow a spark to occur upon initiation by the spark initiator and also holds the PCA securely. The remote initiator further includes configuring means adapted to allow the receiver to be field bondable such that the receiver can be configured to any transmitter, zeroizer configured by software to allow the configuration of the receiver to be blanked so that the receiver cannot be initiated by any transmitter until such time as the receiver is field-bonded by the configuration means, a multifunctional battery cap adapted to withstand ±25 KV electrical static
(Continued)

discharge (ESD) events and allows for the receiver to stand upright, and an antenna capable of withstanding ±25 KV ESD events.

22 Claims, 11 Drawing Sheets

(51) Int. Cl.

| | |
|---|---|
| ***F42C 11/00*** | (2006.01) |
| ***F42B 3/14*** | (2006.01) |
| ***F42C 13/04*** | (2006.01) |
| ***F42D 1/04*** | (2006.01) |

(56) References Cited

U.S. PATENT DOCUMENTS

| | | | | |
|---|---|---|---|---|
| 2008/0121097 | A1* | 5/2008 | Rudakevych | F41A 19/58<br>89/28.05 |
| 2010/0005994 | A1* | 1/2010 | Jacobson | F42D 1/05<br>102/215 |
| 2011/0174181 | A1* | 7/2011 | Plummer | F42C 17/04<br>102/202.7 |
| 2011/0219977 | A1* | 9/2011 | Lucas | F42C 19/0807<br>102/202.7 |
| 2012/0192744 | A1* | 8/2012 | Ballantine | F42B 3/14<br>102/202.8 |
| 2015/0211833 | A1* | 7/2015 | Humphries | F42D 1/045<br>102/215 |

* cited by examiner

REMOTE INITIATOR RECEIVER

The invention relates to a remote initiator receiver, typically a remote initiator receiver for initiating shock tubes.

BACKGROUND OF INVENTION

The safety aspect and reliability of detonating of explosives is paramount as the consequences associated unsafe and unreliable detonation can be castrophic. As such there are requirements for the military, other related defence agencies and other users of explosives to safely detonate explosives. Safely in this context means: safely separated in distance, safely separated in time and security of initiation. Explosives can be initiated by electrical circuit cable or other non-electrical 'cable', however in cases of electrical initiation, long cable lengths allow greater susceptibly to initiation of the charge via electro-magnetic induction onto the cable (radio signals or lightning strikes).

Security of initiation requires that the explosive must not be initiated falsely, either because of erroneously decoded signals or deliberately spoofed signals. Also to ensure the extremely high level security required, the equipment must be protected against the possibility of the failure of microprocessors and the program code. The firing circuits must also be designed and analysed to a very high standard to ensure that component failure will not result in the firing voltage being incorrectly applied to the explosive circuit.

The remote initiation equipment needs to be as small in volume and as light weight as possible. The radio transmission system needs to operate over a good distance. The equipment needs to be very robust, being carried in extreme environments and conditions that include temperatures from −21° C. to +58° C., water depth of 1 meter and in aircraft flying to 30,000 ft.

Current remote initiator (RI) equipment are generally bulky and heavy with weights around 1.5 kg and volumes around 1500 cubic cm. This weight and volume is driven by the need to increase power endurance which leads to existing cumbersome battery solutions. Further the frequency bands may not be well chosen to achieve the required distances. This can also lead to increased power demand through the selected transmitter power level. RI's having a single microprocessor can be suspect, as either a simple failure of the electronic machine or an untested software path could result in the triggering of the firing circuit. The safest assumption to make about a microprocessor and its program is that it could arbitrarily decide to initiate a firing event. To guard against such an event, a secondary processor with its own independent control of the firing circuit can be incorporated.

None of the existing remote initiators provide simplicity of use. A considerable amount of training and experience is required in any but the most simple of deployments.

OBJECT OF THE INVENTION

It is an object of the invention to provide a remote initiator receiver, typically a remote initiator receiver for initiating shock tubes that ameliorates some of the disadvantages and limitations of the known art or at least provide the public with a useful choice.

SUMMARY OF INVENTION

In a first aspect the invention resides an expendable remote initiator receiver for initiating at least one shock tube connectable to an explosive charge, wherein the receiver includes:

(i) a shock tube interface adapted to interface directly with the shock tube connected to an explosive charge, (ii) a spark initiator for initiating a spark at the shock tube interface in order to initiate the shock tube, (iii) multifunctional shock tube interface adaptor mounted and connected to the shock tube interface, the multifunctional shock tube interface adaptor connects the ground of a printed circuit assembly (PCA) to the shock tube needle to allow a spark to occur upon initiation by the spark initiator and holds the PCA securely, (iv) receiver means for receiving a coded signal from a transmitter, (v) input means for inputting operational commands into the receiver for generating an output signal for the initiation of the shock tube upon receipt of a valid transmitted coded signal, (vi) dual processing means that are independent of each other to provide independent control of a firing circuit and the processing means are adapted to synchronise with each processing means before initiation can occur so as to enhance safety and reliability of the receiver and the initiation thereof, (vii) configuring means adapted to allow the receiver to be field bondable such that the receiver can be configured to any transmitter, (viii) zeroising means adapted by configured software to allow the configuration of the receiver to be blanked so that the receiver cannot be initiated by any transmitter until such time as the receiver is field-bonded by the configuration means, (ix) a multifunctional battery cap adapted to withstand ±25 KV electrical static discharge (ESD) events and allows for the receiver to stand upright, (x) antenna capable of withstanding ±25 KV ESD events, (xi) LCD display icons to display battery levels, RF signal, group number and timer initiated firing (TIF), (xii) a keypad to allow inputting of commands into the receiver, and (xiii) a power supply to provide power to the receiver.

Preferably, the configuring means includes a programmed microprocessor to allow the receiver to be configured by any transmitter that has the ability to configure the receiver so that the receiver is field bondable to the configurable transmitter such that the receiver can only be used with the configurable transmitter until otherwise configured by another transmitter.

Preferably, the zeroising means allows the receiver to be zeroised without a transmitter by using the LCD display and/or keypad to select the zeroising option from the appropriate menu in order to enable zeroising of the receiver by the software configuration.

Preferably, the receiver is manufactured and supplied a zeroised state without user or group codes stored in the receiver.

Preferably, the zeroising means includes a programmed microprocessor to allow the receiver to be un-configured or reset back to an initial manufactured state.

Preferably, the zeroising means receives and processes a signal from a uniquely configured transmitter such that the receiver is set to a pre-determined user and group code to allow the receiver to be un-configured or reset back to an initial manufactured state.

Preferably, the receiver upon receiving a zeroising transmission will display a return to factory state that covers and not limited to user, group and circuit identifier.

Preferably, the spark initiator includes a needle nut assembly connectable to the multifunctional shock tube interface adaptor, the needle nut assembly has a needle nut, needle and a high voltage capacity medium to ensure the high voltage is carried to the tip of the needle via said medium for the creation of the spark required for initiation.

Preferably, the medium is a kapton coated wire.

Preferably, the remote initiator receiver includes talk back means adapted to allow the receiver to be interrogated by a transmitter, when the receiver is armed and is field-bonded to that transmitter, and to allow the interrogated information to be displayed on that transmitter without the operator having to physically interact with the receiver.

Preferably, the operating range of talkback means is 1000 m Line of Sight (LOS) and 200 m NON-LOS.

Preferably, the antenna is an external antenna situated on the receiver.

Preferably, the antenna is flexible and able to be folded up or down.

Preferably, the receiver has a covering means removeably clipable to the receiver to cover and protect the receivers keypad and to assist in the holding the antenna when the antenna is in the folded position.

Preferably, the base of the receiver has a multi layered design to allow the receiver to withstand ±25 KY ESD events.

Preferably, the receiver is adapted to be used only once.

Preferably, the remote initiator is made from light weight materials to enable the receiver to be easily and readily transportable.

Preferably, the receiver has a mechanical interface for clipping onto a shock tube.

Preferably, the shock tube interface accommodates for differing diameters of shock tube.

Preferably, the receiver includes dual safety timers with independent timing sources such that the dual safety timers are adapted to prevent arming of the receiver until a fixed time has elapsed from the initiation of arming so that if the two safety timers do not time out within a specified time of each other the receiver indicates an error and does not proceed to its armed state.

Preferably, the receiver includes built-in test circuits to confirm safety, reliability, and shut down in safe state if fault detected.

Preferably, the firing is done remotely where the firing signal is relayed from a transmitter to the receiver by radio frequency.

Preferably, the receiver is adapted to operate and withstand environmental extremes.

Preferably, the receiver is adapted to be transportable in saltwater to depth of 1 meter and to operate in temperature range of −21° C. and +58° C. and still be operable without degradation of operation capabilities.

In a second aspect the invention resides an expendable remote initiator for initiating at least one shock tube connectable to an explosive charge, wherein the remote initiator includes:

(i) a transmitter having means for generating and transmitting a coded signal and input means for inputting operational commands into the transmitter for generating the coded signal, (ii) at least one receiver, wherein the receiver includes a. shock a shock tube interface adapted to interface directly with the shock tube connected to an explosive charge, b. a spark-initiator for initiating a spark at the shock tube interface in order to initiate the shock tube, c. multifunctional shock tube interface adaptor mounted and connected to the shock tube interface, the multifunctional shock tube interface adaptor connects the ground of a printed circuit assembly (PCA) to the shock tube needle to allow a spark to occur upon initiation by the spark initiator and holds the PCA securely, d. receiver means for receiving a coded signal from a transmitter, e. input means for inputting operational commands into the receiver for generating an output signal for the initiation of the shock tube upon receipt of a valid transmitted coded signal, f. dual processing means that are independent of each other to provide independent control of a firing circuit and adapted to synchronise with each processing means before initiation can occur so as to enhance safety and reliability of the receiver and the initiation thereof, g. configuring means adapted to allow the receiver to be field bondable such that the receiver can be configured to a transmitter, h. zeroising means adapted by configured software to allow the configuration of the receiver to be blanked so that the receiver cannot be initiated by a transmitter until such time as the receiver is field-bonded by the configuration means, i. a multifunctional battery cap adapted to withstand ±25 KV electrical static discharge (ESD) events occurring and allows for the receiver to able to stand upright, j. antenna capable of withstanding ±25 KV ESD events, k. LCD display icons to display battery levels, RF signal, group number and timer initiated firing (TIF), l. a keypad to allow inputting of commands into the receiver, and m. a power supply to provide power to the receiver.

Any other aspects herein described

BRIEF DESCRIPTION

The invention will now be described, by way of example only, by reference to the accompanying drawings:

FIG. 1 is a front perspective view of the remote initiator receiver in accordance with a preferred embodiment of the invention.

FIG. 2 is a front perspective view of the remote initiator receiver as shown in FIG. 1 having a removeable cover thereon.

FIG. 3 is a side view of the remote initiator receiver as shown in FIG. 1.

FIG. 4 is back view of the remote initiator receiver as shown in FIG. 1.

FIG. 5 is top view of the remote initiator receiver as shown in FIG. 1.

FIG. 6 is an isometric view of the shock tube interface adaptor in accordance with a preferred embodiment of the invention.

FIG. 7 is an isometric view of the needle nut in accordance with a preferred embodiment of the invention.

FIG. 8 is an isometric exploded view of the shock tube interface, shock tube interface adaptor, needle nut in accordance with a preferred embodiment of the invention.

FIGS. 9 to 12 are flow charts showing the steps for configuring, deploying the receiver in remote initiated firing (RIF) mode to initiate detonation, performing talk back, and zeroising in accordance with a first preferred embodiment of the invention.

DESCRIPTION OF DRAWINGS

The following description will describe the invention in relation to preferred embodiments of the invention, namely a remote initiator receiver, typically an expendable remote initiator receiver for initiating shock tubes. The invention is in no way limited to these preferred embodiments as they are purely to exemplify the invention only and that possible variations and modifications would be readily apparent without departing from the scope of the invention.

The expendable remote initiator of the invention includes a transmitter, one or more expendable receivers with some minor accessories. The expendable receiver accepts a signal from a transmitter that is in a structured format for decoding. The core format includes but is not limited to code parts that include: a user code, a group code and a circuit code.

Figure 1:
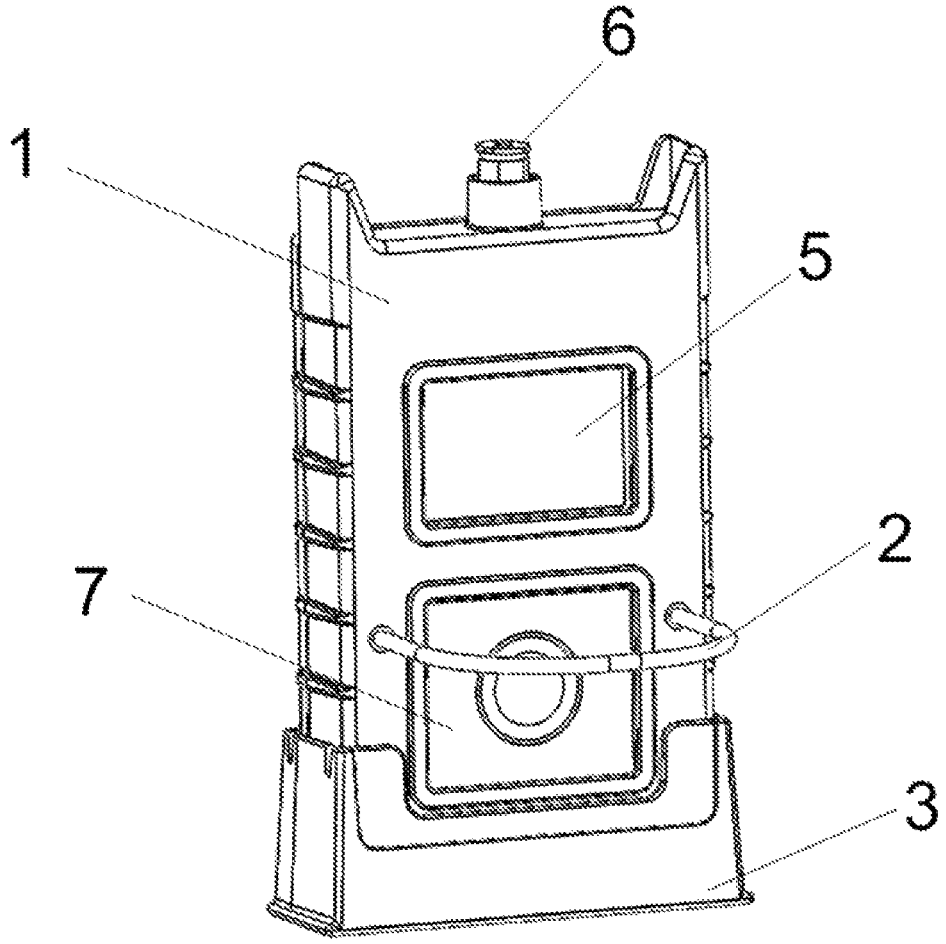

The user code ensures that equipments supplied to separate military units cannot be initiated by some other military unit, i.e. a different country. The group code allows for different elements of a common military force to use the initiator without triggering equipments deployed by other parts of the same force. The user and group codes are set in the transmitter at the time of manufacture or during high level maintenance. The circuit code allows for multiple and separate charges to be fielded and initiated separately.

The remote initiator can consist of a minimum group of one transmitter and one expendable receiver.

A built in self-test function is performed on both transmitter and expendable receivers at switch on. Further automatic tests are performed on the execution of various functions, e.g. battery level, charging voltage etc. Test failures are displayed on the LCD display as individual error codes and the equipment is put into a safe state. The signal strength of transmission to receivers can be performed and observed at the receivers by the deployment personnel.

The expendable receiver build standard provides operational capabilities in extreme environments; including water to a depth of 1 meter, temperature range of −21 C and +58° C., carriage in un-pressurised aircraft to 30,000 ft.

A timer initiation function is included that permits receivers to initiate the detonation after a settable elapsed time delay. The receiver, while in an armed timer initiation state may still be fired by a remote radio command. A radio command to cancel the timer initiation function can also be issued. The receiver remains receptive to remote initiation commands after a cancellation of the timer initiation function.

To guard against unwarranted triggering of the firing circuit, the remote initiator includes two microprocessors, a primary processor and secondary processor, whereby each processor is provided with its own independent control of the firing circuit. Further the program for such the secondary processor is preferably written by an independent software team to that used for the software of the primary processor. The likelihood of two such independent processors deciding to initiate a firing event together is astronomically remote.

The remote initiators design and its implementation have had particular attention paid to its safety:

- The circuitry subjected to Fault Tree Analysis (FTA) to ensure that no single component failure could result in an unsafe condition.
- The design includes two microprocessors with separate control of the firing circuit.
- Each microprocessor is of a different type to ensure no common failings in each microprocessor.
- The programs for the microprocessors are written by independent software teams with different software writing tools.
- The circuitry is subjected to Failure Modes Effect and Criticality Analysis.

During the receiver configuration opportunity an expendable receiver will respond to the transmitters low power configuration transmission. The expendable receiver then updates its internal code to match the user/group/circuit codes of the transmitter. Once the configuration opportunity is passed the configuring transmitter can only be used with the expendable receiver until otherwise configured by another transmitter. For the receiver to allow configuration with any transmitter the feature is called field bond ability. The field bond ability is available through the combination of software and hardware and is a standard feature in the expendable receiver. This feature allows the receiver to be manufactured without user or group codes stored on the receiver. The receiver is manufactured so that it is supplied zeroised and can be configured by any transmitter that has the ability to configure an expendable receiver. A transmitter must have the ability to send a configuration command on a pilot frequency for field bond ability to function.

As explained above the receiver has a zeroise feature that allows the receiver to be un-configured or reset back to an initial manufactured state. The zeroised feature is performed in software. For the receiver to be zeroised a uniquely configured transmitter is required that is set to a predetermined user and group code. The transmitter while in the configuration menu should have the circuit identifier set to '00' before transmitting. Upon receiving a transmission the receiver will display a return to factory state that covers and not limited to user, group and circuit identifier.

A further function of the transmitter radiates a full power test signal that can be checked at any receiver to determine that there is sufficient signal at such receivers for reliable transmission.

The expendable receivers are able to be used in combat situations where the initiation of demolitions in which the operator does not return to the site of the demolition. In this situation the receiver unit will not be recovered and hence it is desirable that the receiver is 'expendable', i.e. destroyed in the demolition.

Such expendable receivers are of a much lower cost and as a consequence many of the superior specifications usually required, but not all, must be sacrificed. Some of the following specification but not limited to may reduce; radio range may reduce in an urban environment, temperature range is reduced to −21° C. to +58° C., water depths are only to 1 meter. The expendable receiver still retains the ability to be carried to an altitude of 30,000 ft, the same easy to use operator functionality, disposable batteries, and the full safety features.

The expendable receiver includes built-in test circuits to confirm safety, reliability, and shut down in safe state if fault detected. The receiver also has dual arming-delay safety timers with time remaining' display, software checks to back up hardware safety breaks. Also the receiver short circuits the arming capacitor until authentication of firing command. Sensitive data held in memory is protected by CRC checksum. There is duplication of critical components so that no single component failure is capable of causing unintended detonation.

Generally the firing code is a binary bit stream, which is base-band, modulated using Manchester encoding, and then transmitted using direct FSK modulation of the RF carrier. Integrity of the transmission comes from the length of the code and the high level of error detection built into the coding scheme. A number of different codes or identifiers are embedded in the transmission which must match keys with the receiver before a firing event is initiated.

Mounted on the front face of the receiver is an ON/OFF push button momentary switch. All receiver functions or mode sequences are controlled by means of the ON/OFF button. This switch is multi-functional. When held down for greater than 600 milliseconds the receiver will power off. Briefly holding the button down and releasing (single tap) will move the receiver into the next mode sequence. To progress through a safety gate a double tap will move the receiver into the Safety Countdown display.

The user has control over the backlighting options. The options available are:

1—Backlight off

2—Backlight on—Night vision mode

3—Backlight on—Normal mode

The receiver incorporates a backlit Four 7-segment Liquid Crystal Display (LCD) screen. If set to option 2 or 3 the screen backlight will remain on for 15 seconds after the last key press.

The expendable receiver employs dual independent processors. Each processor is of a different type. Code for each processor is written by independent software teams to avoid common coding errors. Software developed in accordance with ISO 9001 and maintained in a controlled documented environment. The software is written following strict coding practices including:

Only one entry and exit point in sub-programs

Strict control on use of registers to minimise accidental over-writes.

Use of a separate register bank for interrupt handling.

Use of interrupts restricted to timing and data reception.

Avoidance of the use of dynamic memory management.

Avoidance of the use of floating point arithmetic

Protection of sensitive data by CRC checksums.

The remote initiator has an optional talkback feature that allows a transmitter, that has the talkback feature enabled, the ability to interrogate a receiver, that has the talkback feature enabled, using a coded transmission. The talkback feature allows operators of the remote initiator to obtain information about the receiver without having to return to the deployed receiver. The receiver while in the armed state will decode the received signal and transmit a response. The response will provide the transmitter operator with information about the receiver without having to physically interact with the receiver. The operating range of talkback is 1000 m LOS and 200 m NON-LOS. Information provided to the transmitter operator covers but not limited to TIF status and battery status.

The remote initiator is designed to command detonate explosives either by radio signals or time. The remote initiator has the flexibility to be employed as an offensive or defensive initiation system for special operations and as a conventional demolition or explosive ordinance disposal (E.O.D.) initiation system. The remote initiator operates by using a UHF radio link or timed initiation thereby overcoming the disadvantages associated with wire based systems. The remote initiator can comprise of one transmitter and more than one receiver depending on operator requirements. Each expendable receiver has been designed to initiate one circuit, commonly referred to as a line.

Figure 2:
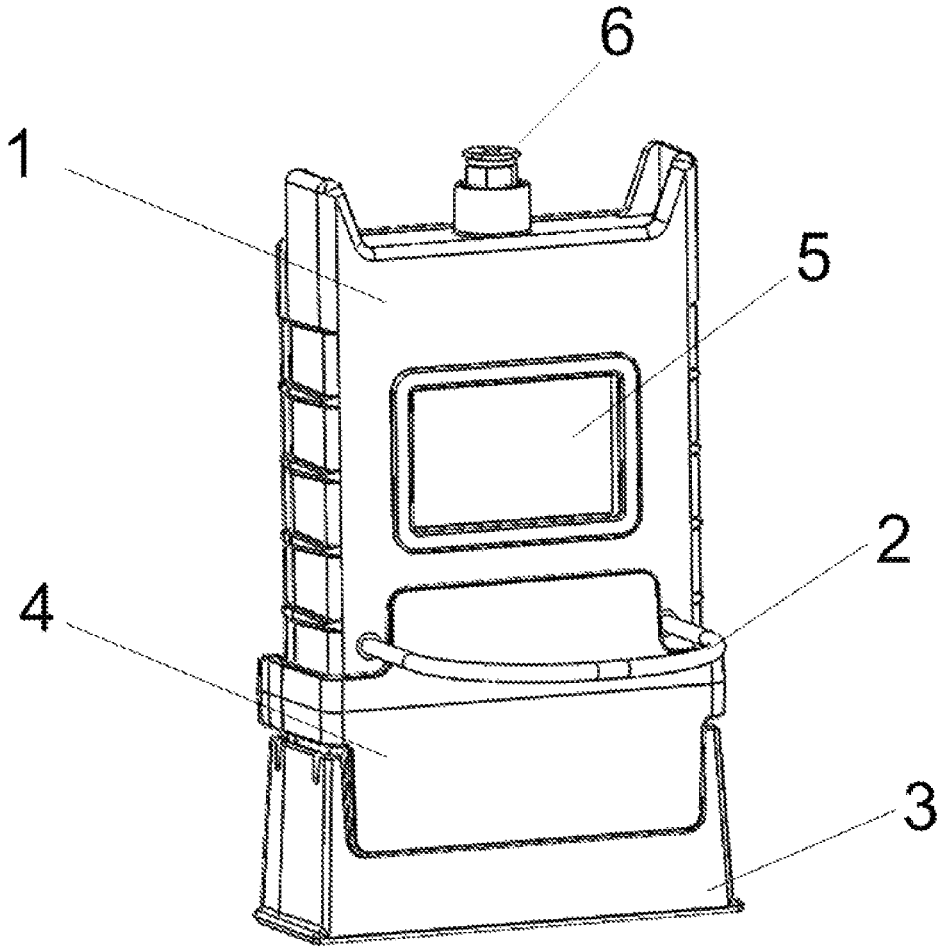
Figure 3:
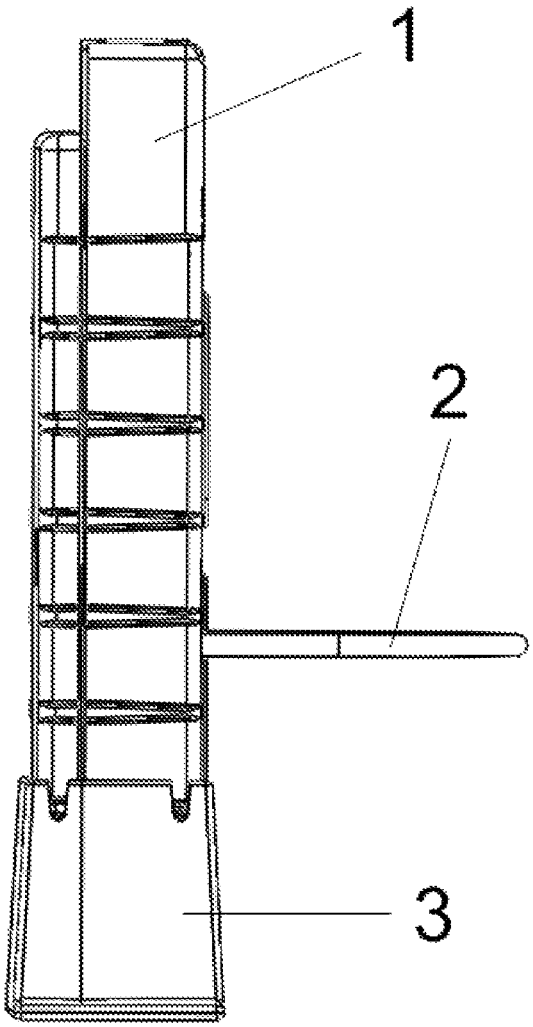
Figure 4:
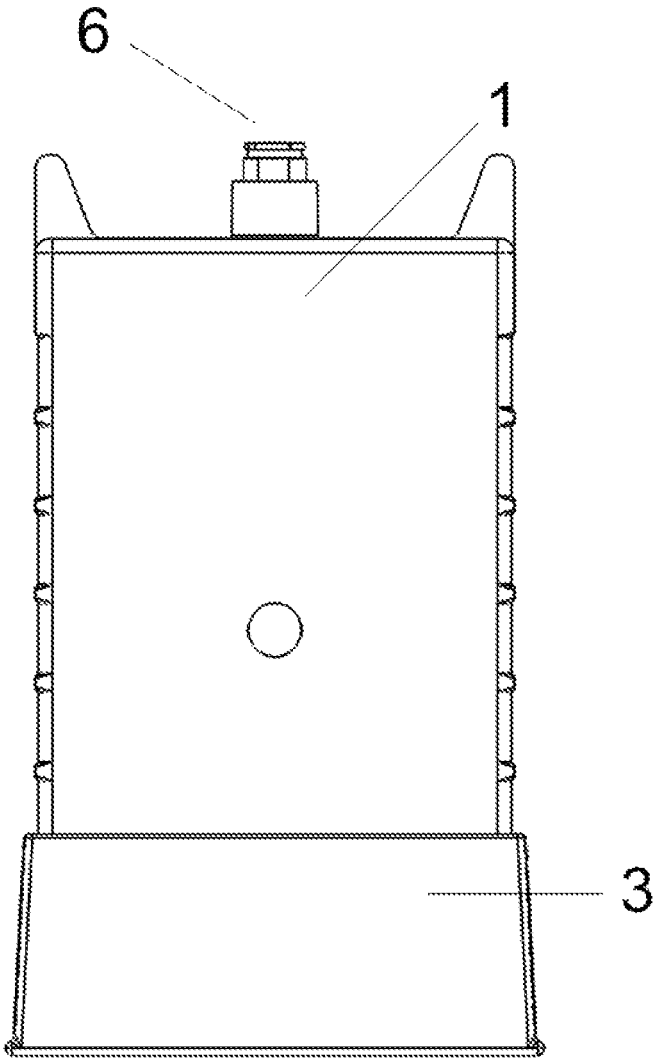
Figure 5:
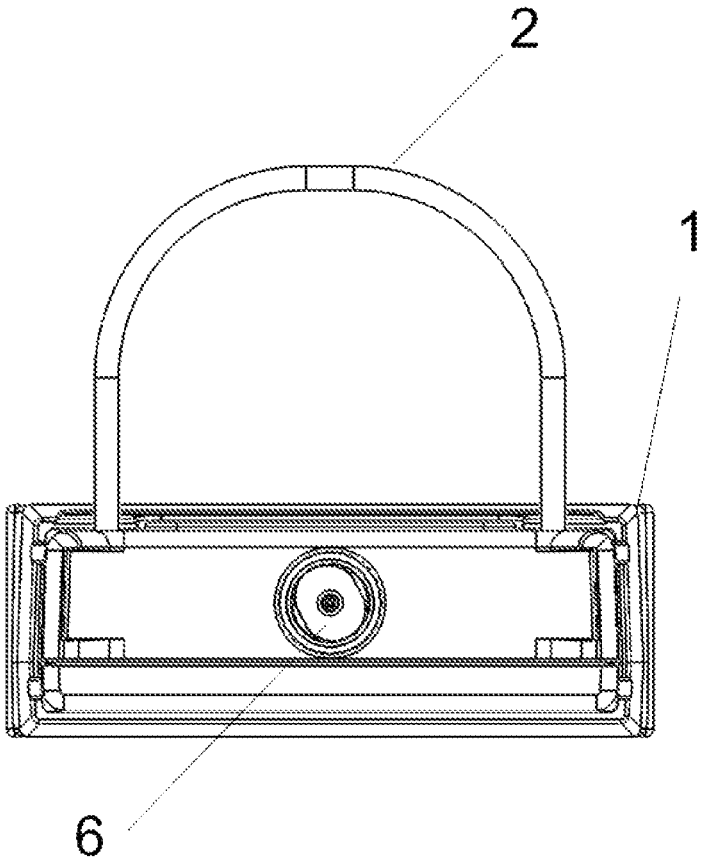

FIGS. 1 to 5 show a preferred embodiment of a remote initiator receiver. FIG. 1 shows the remote initiator receiver in one operation mode and in its operation orientation allowing external antenna 2 to be used. FIG. 2 shows the same receiver as in FIG. 1 in another operation mode with a button cover 4 thereon. The button cover 4 is removeably clipped to the housing 1 of the receiver such that button cover 4 is able to cover and protect the receivers keypad 7 and to assist in the holding the antenna 2 when the antenna is in a folded position.

The remote initiator receiver has a housing 1 made from plastic such as acrylonitrile-butadiene-styrene (ABS) or poly carbonate (PC), typically though the material used is a PC/ABS blend preferably a 60/40% blend. The housing 1 has and external antenna 2 this is able to withstand ±25 KV electric static discharge (ESD) events. The antenna 2 is flexible so that is able to fold up or down during storage and prevents antenna damage if knocked. The housing 1 includes a multifunctional battery cap 3 situated at the base of the receiver so that the receiver is able to stand upright as shown in FIGS. 1 & 2. The multifunctional battery cap withstands ±25 KV ESD events occurring and affecting the functions of the receiver. The multifunctional battery cap 3 is made from plastic such as ABS or PC or ABS/PC blend. The multifunctional battery cap 3 has a multi layered design and is designed to allow the keypad cover to be assembled at the same time. Situated on the upper front face of the receiver 1 is a LCD 5 for displaying thereon information such as battery levels, RF signal, group number, TIF timer activated/running, etc. Also situated on the front face below LCD 5 is a membrane type key pad 7 for the inputting of commands into the receiver. The commands into the receiver by keypad 7 enable an output signal to be generated for the initiation of the shock tube upon receipt of a valid transmitted coded signal. A shock tube interface 6 is situated on the top of the receiver housing 1 to allow the receiver to interface directly with a shock tube connected to an explosive charge. The shock tube interface 6 is able to accommodate differing diameters of shock tube.

The receiver has a spark-initiator for initiating a spark at the shock tube interface in order to initiate the shock tube. The receiver includes dual processors that are independent of each other to provide independent control of a firing circuit and adapted to synchronise with each processor before initiation can occur so as to enhance safety and reliability of the receiver and the initiation thereof. The receiver has dual safety timers with independent timing sources such that the dual safety timers prevent arming of the receiver until a fixed time has elapsed from the initiation of arming so that if the two safety timers do not time out within a specified time of each other the receiver indicates an error and does not proceed to its armed state. The receiver has built-in test circuits to confirm safety, reliability, and shut down in safe state if fault detected. The firing is done remotely where the firing signal is relayed from a transmitter to the receiver by radio frequency.

The receiver is able to be configured to allow the receiver to be field bondable such that the receiver can be configured to any transmitter. However for improved safety the receiver has zeroising functionality to allow the configuration of the receiver to be blanked so that the receiver cannot be initiated by any transmitter until such time as the receiver is field-bonded to a transmitter so that the receiver is able to receive a coded signal from a transmitter. The receiver has talk back functionality to allow the receiver to be interrogated by a transmitter when the receiver is armed and is field-bonded to that transmitter, and to also allow the interrogated information to be displayed on that transmitter. The receiver has a spark-initiator for shock-tube detonators. The receiver shock tube interface 6 is designed to handle a wide range of environmental conditions. The receiver is designed as an expendable unit and is intended to be used operationally only once.

Figure 6:
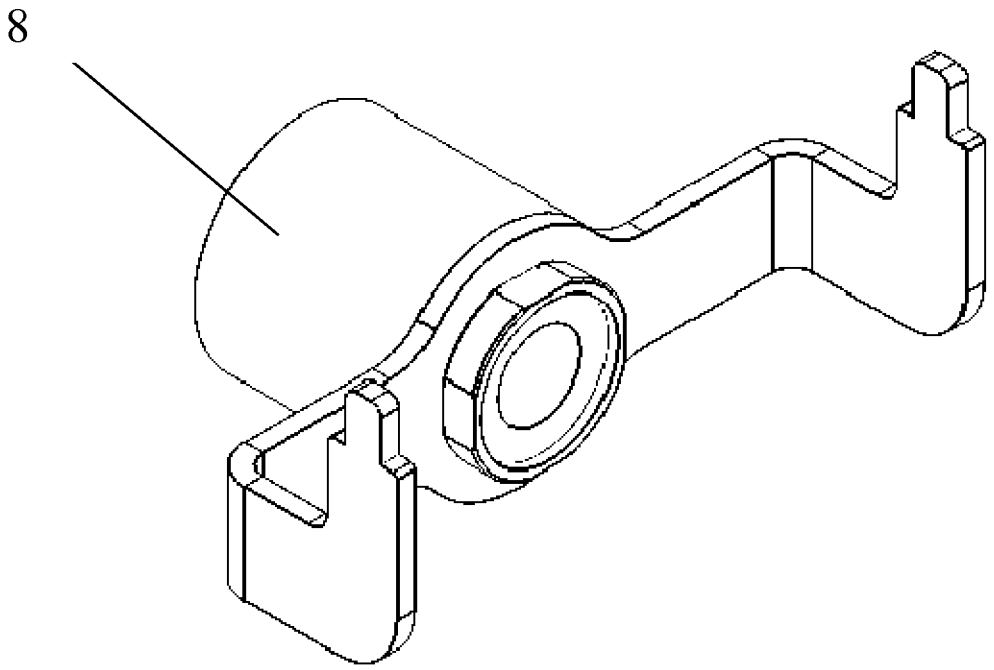
Figure 7:
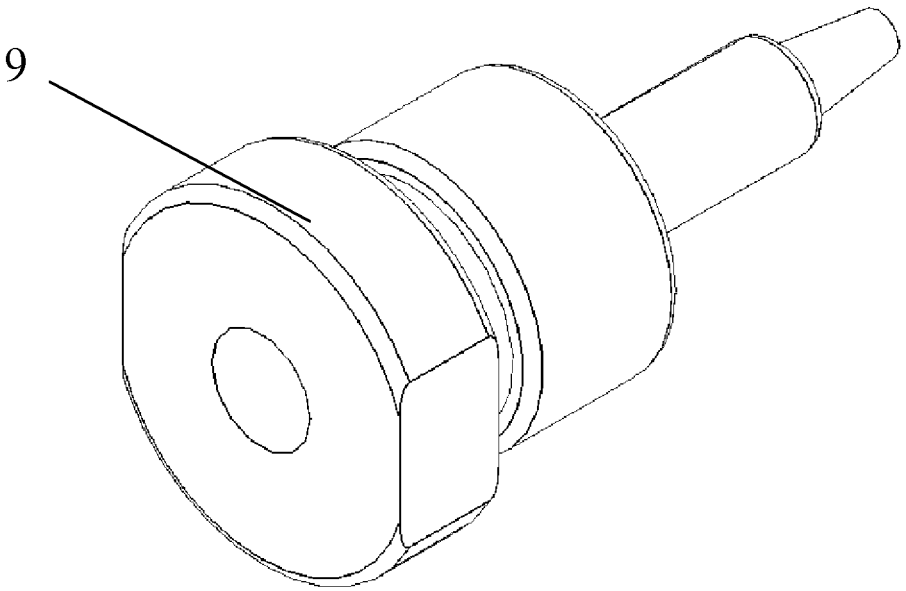
Figure 8:
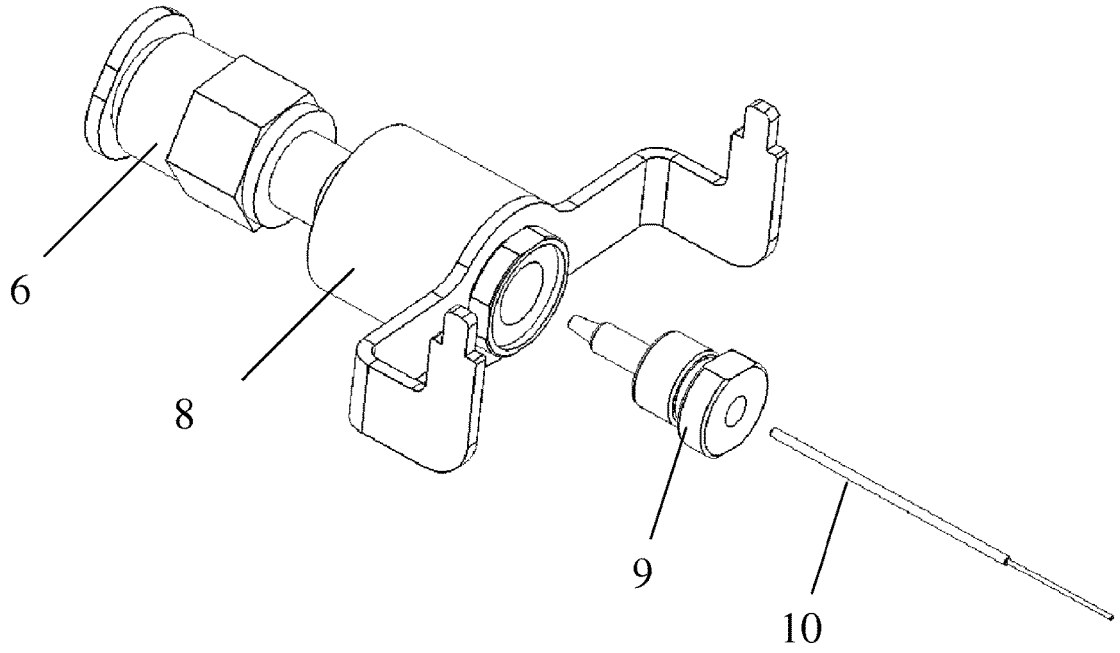

A further feature of the invention is shown in FIGS. 6 to 8 showing a multifunctional shock tube interface adaptor 8 and needle nut 9. The receiver uses a custom designed multifunctional shock tube interface adaptor 8 that is used to connect the PCA to the shock tube interface 6 as well as retain the PCA securely in a fixed position. The interface adaptor 8 is manufactured to allow easy operator assembly of the shock tube adaptor. The interface adaptor 8 allows the easy assembly of the needle nut assembly during manufacture, FIG. 7 shows the needle nut 9 only and not the full assembly. FIG. 6 only shows the interface adaptor 8 and not the interface adaptor assembly. The needle nut assembly is the key part that creates the spark for initiation. The needle nut assembly must ensure it has a good connection to ground established through the interface adaptor and that the high voltage is carried to the tip of the needle using a medium (Kapton coated wire) 10 forming part of the interface needle nut assembly. The structural features of the interface adaptor 8 ensures the PCA is held fast in place to meet strict military standards for drop and vibration, the interface adaptor 8 is simple to manufacture and can be retained in the receiver housing by injection moulding. The material the interface adaptor 8 is made of is selected due to its electrical characteristics. FIG. 8 shows in exploded view the multifunctional shock tube interface adaptor 8 coupled to the shock tube interface 6 and coupled to the needle nut 9 with a kapton wire 10.

The power supply that provides power to the receiver is powered by a battery or by batteries. The receiver is able to operate and withstand environmental extremes. The receiver is able to be transported in saltwater to depth of 1 meter and then be operated without degradation of operation capabilities. The receiver is able to operate in temperature range of −21° C. and +58° C.

Turning to the flow charts of FIGS. 9 to 12 which set out the operating process of the remote initiator.

Figure 9:
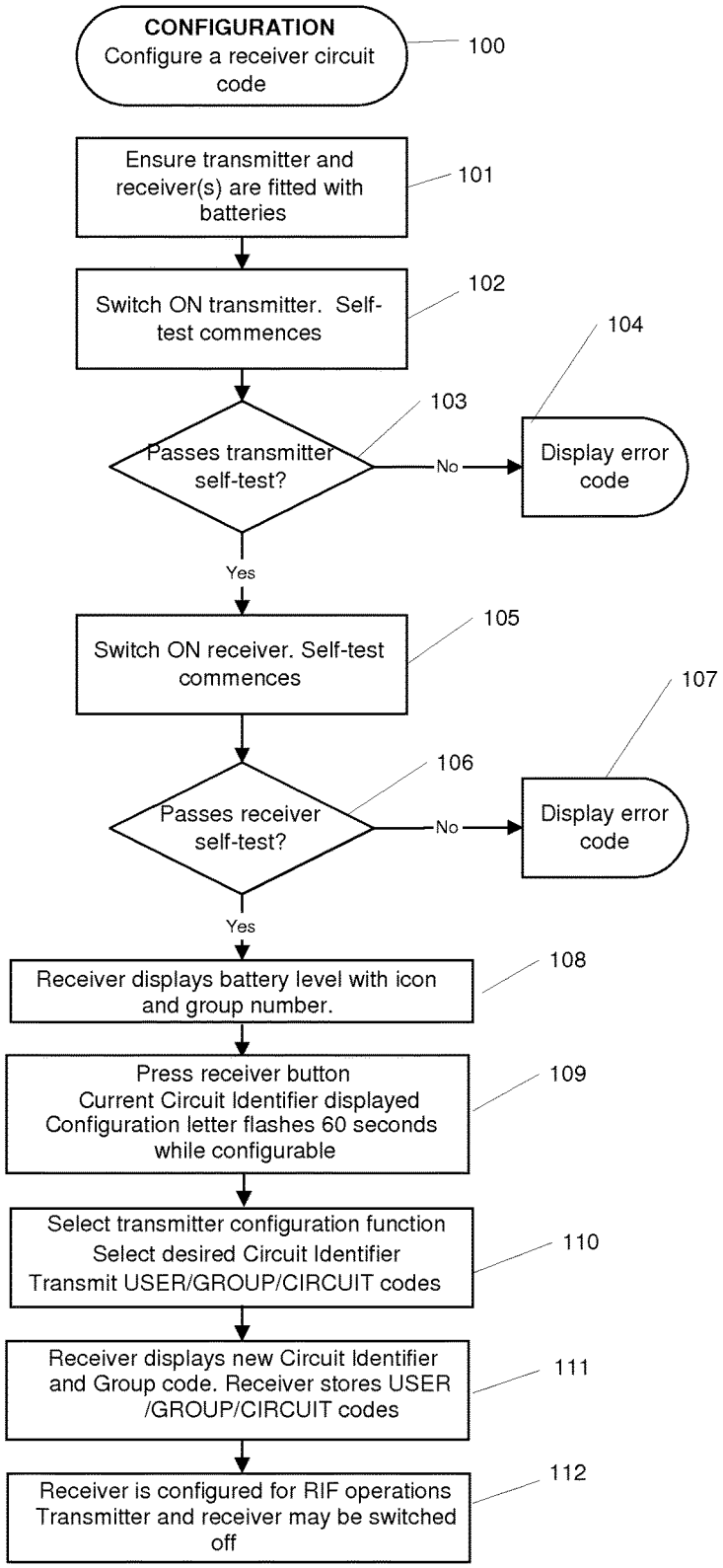

FIG. 9 relates to the configuration 100 of a receiver circuit code. Before turning on, check the transmitter and receiver(s) to see if they are fitted with batteries and the transmitter and antenna, 101. If okay then the transmitter is turned on and a self test is commenced, 102. The outcome of the self test, 103, displays an error code, 104, if the test fails or continues if the test is okay. Then the receiver is switched on and a self test is commenced, 105. The outcome of the self test, 106, displays an error code if the test fails, 107, or continues if the test is okay. If okay the battery level is displayed with icon along with its present group number, 108, then by pressing the receiver button causes the current circuit identifier to be displayed and the configuration letter flashes for 60 seconds while configurable, 109. Then the transmitter configuration function is selected and circuit identifier selected, the user/group/circuit values are then transmitted, 110. The receiver displays the circuit identifier and group code and stores the user, group and circuit identifier codes, 111. The receiver is now configured for RIF operations, the transmitter and receiver can be switched off until required, 112.

Figure 10:
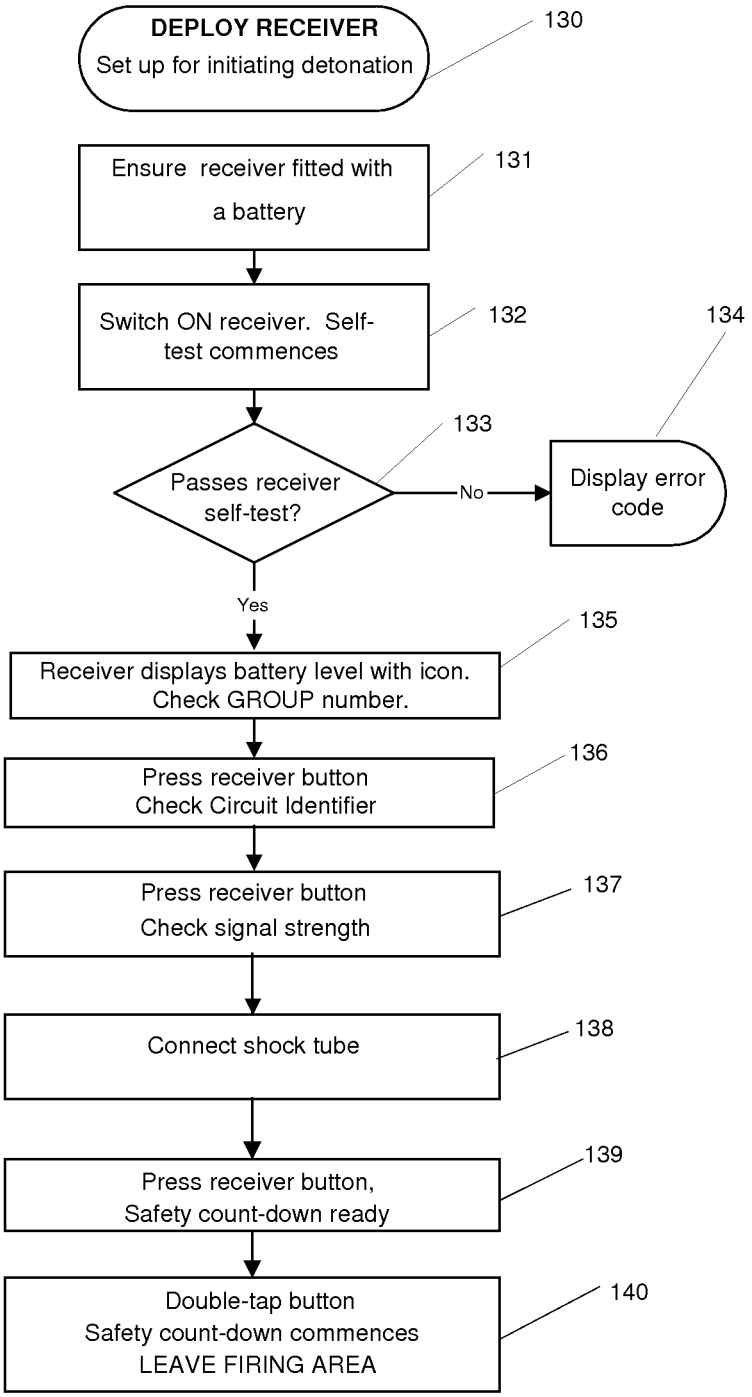

FIG. 10 relates to the deploying of the receiver and setting up for initiating detonation, 130. The receiver is checked to ascertain if fitted with a battery, 131. If so, then it is switched on and the self test commences 132. The outcome of the self test, 133, displays an error code if the test fails, 134, or continues if the test is okay. If okay the battery level is displayed with icon, check group number is correct before continuing, 135, then by pressing the receiver button causes the current circuit identifier to be displayed, check the circuit identifier, 136. Press the receiver button is to view and check the signal strength, 137. While in signal strength attach the shock tube to the receiver, 138. The receiver button is then pressed again to display that the safety count-down is ready to be started, 139. The receiver button is then double tapped to commence the safety count-down, 140. The operator shall then leave the area and will not return until either it has successfully initiated or perform a return drill where they wait for a fixed amount of time if it has not initiated. The receiver will then become armed awaiting to receive an initiation command from the configuring transmitter.

Figure 11:
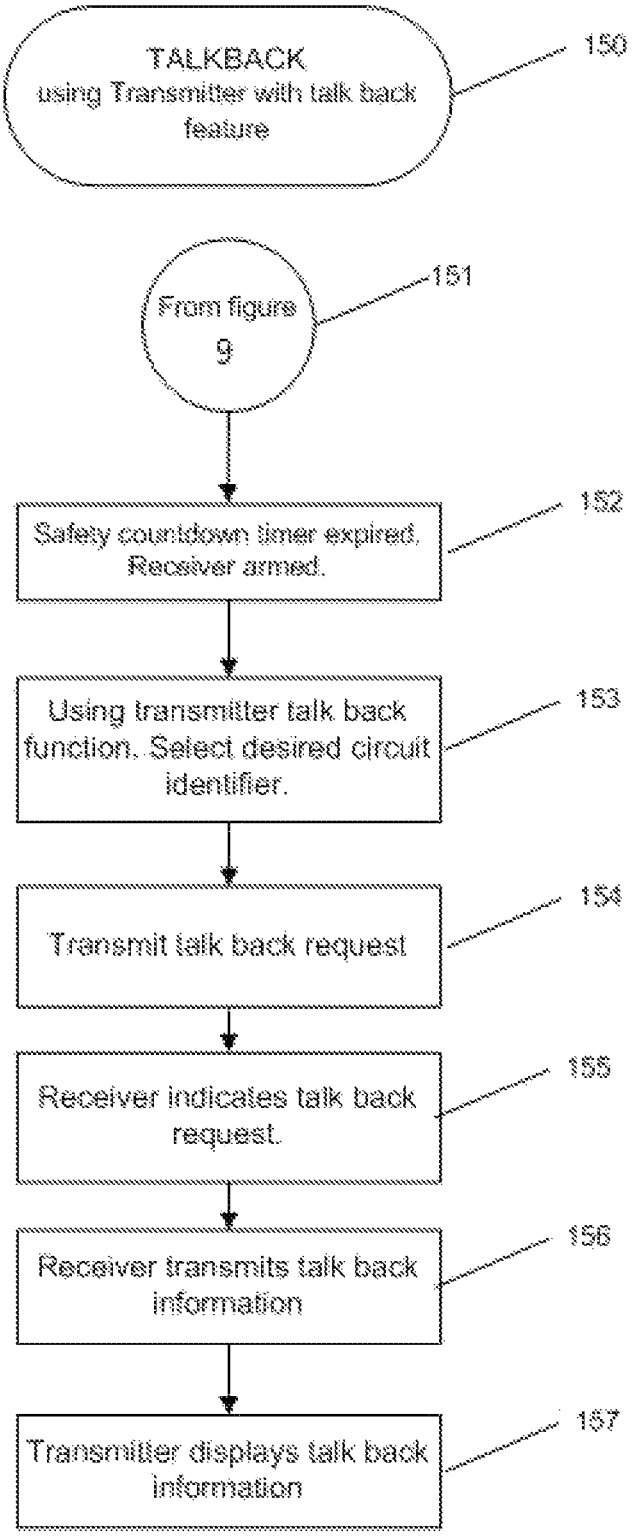

FIG. 11 relates to the talkback function, 150, of a receiver and transmitter. Following on from FIG. 9 the receiver shall be armed after the safety countdown timer has expired to receive a talk back request, 152. Using a transmitter, with talk back enabled, while in the talk back function the correct circuit identifier is selected, 153, a request transmission is then performed, 154. The receiver indicates a valid talk back request on the LCD by displaying a valid symbol representing the request, 155. Once the receiver has decoded the request and determined the request was for it the receiver progresses to transmit talk back information back to the requesting transmitter, 156. The transmitter then displays all the received talk back information in a structured way on the LCD, 157.

Figure 12:
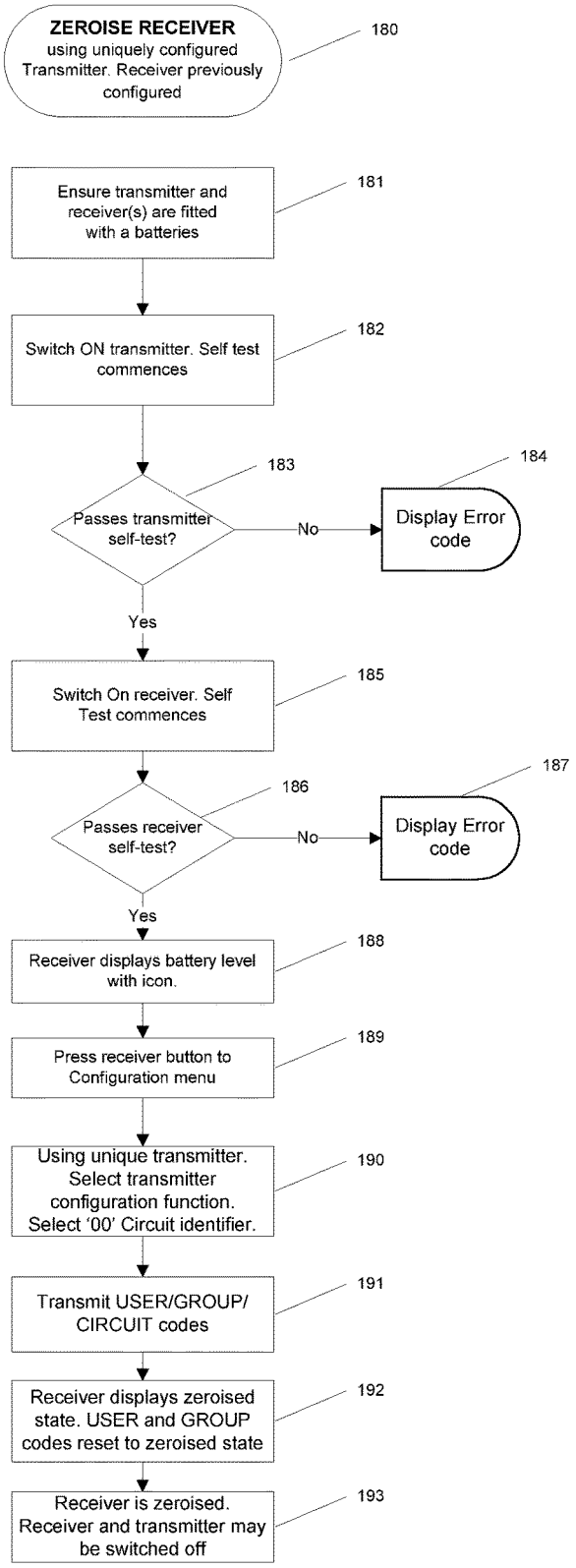

FIG. 12 relates to the zeroising, 180, of a receiver circuit code. Before turning on, check the transmitter and receiver(s) to see if they are fitted with batteries and the transmitter an antenna, 181. If okay then the transmitter is turned on and a self test is commenced, 182. The outcome of the self test, 183, displays an error code, 184, if the test fails or continues if the test is okay. Then the receiver is switched on and a self test is commenced, 185. The outcome of the self test, 186, displays an error code if the test fails, 187, or continues if the test is okay. If okay the battery level is displayed with icon along with its present group number, 188, then by pressing the receiver button causes the current circuit identifier to be displayed and the configuration letter flashes for 60 seconds while configurable, 189. Using a uniquely configured transmitter the configuration function is selected and circuit identifier value of '00' is selected, 190. The user/group and circuit codes are transmitted, 191. The addressed receiver will acknowledge a signal received and progress to update the LCD with its zeroised status '--' for the circuit identifier and '----' for the group the user code is also reset to a zeroised state, 192. The transmitter and receiver can now be switched off.

The preferred specification requirements of the remote initiator are as follows:

Receiver Size—80.5(W)×139.5(L)×30(D) mm

Receiver Weight--170 grams, excluding battery

Preferred electrical specifications are as follows:

| | |
|---|---|
| Operating Frequency | 300-960 MHz |
| Installation Type | Man Portable |
| Channel Spacing | 12.5 kHz |
| Modulation | FSK |
| Frequency Control | VTCXO |
| Frequency Stability | +/−1.5 ppm (all causes) |
| Operational Range | 1200 m Non-LOS, 2-3 KM LOS |
| Error Detection Method | Cyclic Redundancy Check (CRC)<br>16 Bit error checking |
| Firing Delay | <2 sec seconds from commencement of firing transmission |

-continued

| | |
|---|---|
| Antenna | external antenna |
| Power & Operating Voltage | 1 × AA Lithium LR91 battery (1.5 v) |
| User Battery Characteristics | Lithium AA LR91 Operating −21° C. to +58° C. |
| Receiver Sensitivity | −121 dBm for 1 × 10-3 errors. |
| Receiver Safety Timer | Post arming delay, via dual independent timers, specified by customer and programmed at manufacture. Standard delay is 5 minutes. |
| Shock-tube Electro-static firing circuit | |
| Stored Energy 3.4 to 6 Joules—Energy stored in arming capacitor. | |
| Stored Energy 260 mJ to 320 mJ—Energy stored in firing capacitor | |

As mentioned the remote initiator receiver incorporates specific safety and security features required for safe and secure firing of the detonator by the remote initiator. These include:

Expendable and intended for a single operational use,

Field-bondable to a transmitter,

Zeorising functionality,

Talk back functionality

Mechanical solution means

Withstands ESD

Built-in test circuits to confirm safety, reliability, and shut down in safe state if fault detected.

A failure results in unit shutdown to a safe state and indication of fault type on LCD.

Software checks to back up hardware safety breaks.

Short circuit of discharge capacitor until authentication of firing command.

Sensitive data held in memory is protected by CRC checksum.

Duplication of critical components so that no single component failure is capable of causing unintended detonation.

Design Safety Features

The remote initiator utilises UHF radio signals to send firing commands from the transmitter to the receiver. Each system operates on a specific frequency. The transmitter can configure any receiver during the configuration opportunity. During this opportunity the configuring transmitter user, group and circuit identifier codes are stored by the receiver. The configuring transmitter is then the only transmitter that can be used to initiate the expendable receiver until another transmitter is used to configure the receiver.

The situation could occur where two systems are deployed operating on the same frequency. Interference will occur if two transmitters are operated at exactly the same time (unlikely given the short transmission duration) within the signal reception area. This will not result in the unintentional firing of a circuit because of the unique code associated with each system. Instead those receivers within the signal reception area will ignore the firing commands. This effect is known as "blocking". In TIF mode both processors run independent clocks, times must synchronize before initiation can take place.

A comprehensive error checking system is employed on the radio transmission, involving a data comparison and validation process. This ensures the integrity of all detonation commands and hence a high safety standard.

The receiver incorporates an ON/OFF push button momentary switch. The ON/OFF switch controls all receiver functions. When the ON/OFF switch is held down for more than >600 ms the receiver will power down. Briefly holding down the ON/OFF switch will allow the operator to move to the next mode in the program sequence. A safety delay of 5 minute duration is incorporated within the receiver prior to arming and is displayed as a countdown from 4:59 minutes to 0 seconds. During the countdown period, cycling through the programme or switching the receiver OFF will disarm the receiver.

The transmitter should only be turned ON when configuring the receiver and when initiating explosives. Two firing buttons are located on the transmitter on two different surfaces. A two handed key press is required to transmit the firing command.

Advantages a) Improved safety b) Timed or Non Timed Initiation c) Single or multi receiver operation d) No single component failure can result in an unsafe condition and firing e) Dual microprocessors f) Multifunctional shock tube interface adaptor g) Receiver able to be field bondable to a transmitter h) Receiver able to returned to manufactured unconfigured state i) Receiver having talk back feature.

Variations

Throughout the description of this specification, the word "comprise" and variations of that word such as "comprising" and "comprises", are not intended to exclude other additives, components, integers or steps.

It will of course be realised that while the foregoing has been given by way of illustrative example of this invention, all such and other modifications and variations thereto as would be apparent to persons skilled in the art are deemed to fall within the broad scope and ambit of this invention as is herein described in the appended claims.

What we claim is:

1. An expendable remote initiator receiver for initiating at least one shock tube connectable to an explosive charge, wherein the receiver includes:

(i) a shock tube interface adapted to interface directly with the shock tube connected to an explosive charge, (ii) a spark initiator for initiating a spark at the shock tube interface in order to initiate the shock tube, (iii) multifunctional shock tube interface adaptor mounted and connected to the shock tube interface, the multifunctional shock tube interface adaptor connects the ground of a printed circuit assembly (PCA) to a shock tube needle to allow a spark to occur upon initiation by the spark initiator and holds the PCA securely, (iv) receiver means for receiving a coded signal from a transmitter, (v) input means for inputting operational commands into the receiver for generating an output signal for the initiation of the shock tube upon receipt of a valid transmitted coded signal, (vi) dual processing means that are independent of each other to provide independent control of a firing circuit and the processing means are adapted to synchronise with each processing means before initiation can occur so as to enhance safety and reliability of the receiver and the initiation thereof, (vii) configuring means adapted to allow the receiver to be field bondable such that the receiver can be configured to any transmitter, (viii) zeroising means adapted by configured software to allow the configuration of the receiver to be blanked so that the receiver cannot be initiated by any transmitter until such time as the receiver is field-bonded by the configuring means, (ix) a multifunctional battery cap adapted to withstand ±25 KV electrical static discharge (ESD) events and allows for the receiver to stand upright, (x) antenna capable of withstanding ±25 KV ESD events, (xi) LCD display icons to display battery levels, RF signal, group number and timer initiated firing (TIF), (xii) a keypad to allow inputting of commands into the receiver, and (xiii) a power supply to provide power to the receiver.

2. The expendable remote initiator receiver as claimed in claim 1, wherein the configuring means includes a programmed microprocessor to allow the receiver to be configured by any transmitter that has the ability to configure the receiver so that the receiver is field bondable to the configurable transmitter such that the receiver can only be used with the configurable transmitter until otherwise configured by another transmitter.

3. The expendable remote initiator receiver as claimed in claim 1, wherein the receiver is manufactured and supplied in a zeroised state without user or group codes stored in the receiver.

4. The expendable remote initiator receiver as claimed in claim 1, wherein the zeroising means includes a programmed microprocessor to allow the receiver to be unconfigured or reset back to an initial manufactured state.

5. The expendable remote initiator receiver as claimed in claim 4, wherein the zeroising means receives and processes a signal from a uniquely configured transmitter such that the receiver is set to a pre-determined user and group code to allow the receiver to be un-configured or reset back to an initial manufactured state.

6. The expendable remote initiator receiver as claimed in claim 5, wherein the receiver upon receiving a zeroising transmission will display a return to factory state that covers and not limited to user, group and circuit identifier.

7. The expendable remote initiator receiver as claimed in claim 1, wherein the spark initiator includes a needle nut assembly connectable to the multifunctional shock tube interface adaptor, the needle nut assembly has a needle nut, the needle and a high voltage capacity medium to ensure the high voltage is carried to the tip of the needle via said medium for the creation of the spark required for initiation.

8. The expendable remote initiator receiver as claimed in claim 7, wherein the medium is a kapton coated wire.

9. The expendable remote initiator receiver as claimed in claim 1, wherein the remote initiator receiver includes talk back means adapted to allow the receiver to be interrogated by a transmitter, when the receiver is armed and is field-bonded to that transmitter, and to allow the interrogated information to be displayed on that transmitter without the operator having to physically interact with the receiver.

10. The expendable remote initiator receiver as claimed in claim 9, wherein the operating range of talkback means is 1000 m Line of Sight (LOS) and 200 m NON-LOS.

11. The expendable remote initiator receiver as claimed in claim 1, wherein the antenna is an external antenna situated on the receiver.

12. The expendable remote initiator receiver as claimed in claim 1, wherein the antenna is flexible and able to be folded up or down.

13. The expendable remote initiator receiver as claimed in claim 1, wherein the receiver has a covering means removeably clipable to the receiver to cover and protect the receivers keypad and to assist in the holding the antenna when the antenna is in a folded position.

14. The expendable remote initiator receiver as claimed in claim 1, wherein the receiver is adapted to be used only once.

15. The expendable remote initiator receiver as claimed in claim 1, wherein the remote initiator receiver is made from light weight material to enable the receiver to be easily and readable transportable.

16. The expendable remote initiator receiver as claimed in claim 1, wherein the receiver includes dual safety timers with independent timing sources such that the dual safety timers are adapted to prevent arming of the receiver until a fixed time has elapsed from the initiation of arming so that if the two safety timers do not time out within a specified time of each other the receiver indicates an error and does not proceed to its armed state.

17. The expendable remote initiator receiver as claimed in claim 1, wherein the receiver includes built-in test circuits to confirm safety, reliability, and shut down in safe state if fault detected.

18. The expendable remote initiator receiver as claimed in claim 1, wherein the firing is done remotely where the firing signal is relayed from a transmitter to the receiver by radio frequency.

19. The expendable remote initiator receiver as claimed in claim 1, wherein the receiver is adapted to operate and withstand environmental extremes.

20. The expendable remote initiator receiver as claimed in claim 1, wherein the receiver is adapted to be transportable in saltwater to depth of 1 meter and to operate in temperature range of −21° C. and +58° C. and still be operable without degradation of operation capabilities.

21. The expendable remote initiator receiver as claimed in claim 1, wherein the zeroising means allows the receiver to be zeroised without a transmitter by using the LCD display and/or keypad to select the zeroising option from the appropriate menu in order to enable zeroising of the receiver by the software configuration.

22. The expendable remote initiator receiver as claimed in claim 1, wherein the expendable remote initiator receiver is used for initiating at least one shock tube connectable to an explosive charge, wherein the remote initiator receiver includes:

(i) a transmitter having means for generating and transmitting a coded signal and input means for inputting operational commands into the transmitter for generating the coded signal.

* * * * *